US006209520B1

(12) United States Patent
Kolmanovsky et al.

(10) Patent No.: US 6,209,520 B1
(45) Date of Patent: Apr. 3, 2001

(54) METHOD AND APPARATUS FOR CYLINDER BALANCING

(76) Inventors: Ilya V. Kolmanovsky, 4439 Hunt Club Dr., Apt #2C, Ypsilanti, MI (US) 48197; Michiel J. Van Nieuwstadt, 1231 Wisteria Dr., Ann Arbor, MI (US) 48104

( * ) Notice: Subject to any disclaimer, the term of this patent is extended or adjusted under 35 U.S.C. 154(b) by 0 days.

(21) Appl. No.: 09/332,974

(22) Filed: Jun. 15, 1999

(51) Int. Cl.[7] ..... F02D 41/14; F02D 41/36
(52) U.S. Cl. ..... 123/435; 123/436; 123/676
(58) Field of Search ..... 123/435, 436, 123/673, 676

(56) References Cited

U.S. PATENT DOCUMENTS 5,058,552 * 10/1991 Shimomura et al. ..... 123/435 X
5,069,183 * 12/1991 Nagano et al. ..... 123/435 X
5,323,748 * 6/1994 Foster et al. ..... 123/435
5,582,151 12/1996 Wertheimer ..... 123/435
5,740,780 * 4/1998 Shimizu et al. ..... 123/435 X
5,878,717 * 3/1999 Zur Loye ..... 123/435
6,000,384 * 12/1999 Brown et al. ..... 123/676

OTHER PUBLICATIONS

J. Martin, Improvements in Transient Diesel Engine Performances by Electronic Control of Injection, 1989, pp. 255–265, Lucas Diesel Systems, Bois, France.
Kevin D. Beaty et al, Integral Gas Compressor Engines: Cylinder Balancing, $NO_x$, and Efficiency, 1997, pp. 9–15, ICE–vol. 28–3, Spring Technical Conference, ASME 1997.
Richard K. Sobart, The Demands of Cylinder Event Control, Feb. 24–27, 1997, pp. 1–8, Paper 970617 SAE Technical Paper Series.

* cited by examiner

*Primary Examiner*—Tony M. Argenbright
(74) *Attorney, Agent, or Firm*—Ford Global Technologies, Inc.

(57) ABSTRACT

An automobile cylinder balancing assembly 10 including a controller 36 which operates under stored program control and which substantially ensures that the torque produced by each of the cylinders 12, 14 is substantially equal, thereby causing the cylinders 12, 14 to be selectively balanced.

16 Claims, 4 Drawing Sheets

METHOD AND APPARATUS FOR CYLINDER BALANCING

FIELD OF THE INVENTION

This invention relates to a method and to an apparatus for cylinder balancing and more particularly to a method and to an apparatus for balancing the cylinders of an automobile engine effective to cause each of these cylinders to produce a substantially equal torque.

BACKGROUND OF THE INVENTION

Automobile engine combustion cylinders typically include a movable piston which is connected to a crankshaft. Particularly, air and gasoline are selectively and mixably combusted within the chambers causing the respectively contained pistons to move within the cylinders and against the crankshaft, thereby cooperatively causing the crankshaft to rotate. The selectively moving pistons therefore cooperatively and individually create a torque which is applied to the crankshaft and which causes the automobile to be selectively movable.

Due to structural variances of each of the respective cylinders, variations in the amount of air introduced into each of the cylinders, and/or variations associated with the fuel injection assemblies utilized by each of the cylinders, the torque produced by each of the cylinders is not substantially equal, thereby causing the cylinders to be "out of balance". This imbalance causes or creates an undesirable crankshaft oscillation and drive train resonance which reduces the operating life of the drive train and increases gasoline consumption and the generation of undesirable combustion created emissions. It is therefore desirable to have the torque produced by each of the cylinders be substantially equal and to have the cylinders "balanced."

Existing cylinder balancing methodologies using individual peak cylinder pressure values or crankshaft acceleration measurements are highly susceptible to noise type error and provide relatively unreliable and inaccurate balancing corrections. There is therefore a need for a new and improved balancer assembly.

SUMMARY OF THE INVENTION

It is a first object of this invention to provide a method and an apparatus for balancing the combustion cylinders of an automobile effective to cause the torque produced by each of the cylinders to be substantially equal.

It is a second object of this invention to provide a method and an apparatus for balancing the combustion cylinders of an automobile by use of pressure sensors, each of which is resident within a unique one of each of the cylinders.

It is a third object of this invention to provide a method and an apparatus for balancing the combustion cylinders of an automobile by the use of a pressure sensor resident within an exhaust manifold.

According to a first aspect of the present invention a cylinder balancing assembly is provided for use with an automobile engine having several combustion cylinders which each contain a movable piston. The engine further includes a movable crankshaft, several conrods which each connect a unique one of the pistons to the crankshaft, and several fuel injectors which are each adapted to receive a quantity of fuel and to selectively inject the fuel into a unique one of the cylinders, the injected fuel being selectively combined with air and combusted within each of the cylinders effective to create a certain respective pressure which cycles each of the respective pistons between a first extended position and a second crankshaft rotation position in which each cylinder produces a torque by having its respective piston rotate the crankshaft and then completing a movement cycle by returning to the respective first position. The cylinder balancing assembly includes several sensors which respectively sense the pressure of a unique one of the cylinders and which respectively provide an output signal representing the respectively sensed pressure; and a controller which is coupled to the several sensors and to the several fuel injectors. The controller receives the output signals from each of the several sensors, uses the output signals to calculate the total amount of torque produced by each of the moving pistons during each of their respective movement cycles, and based upon the calculation regulates the amount of fuel entering each of the fuel injectors effective to cause each of the produced torques to be substantially equal, thereby balancing the cylinders.

According to a second aspect of the present invention a method is provided to cause the torque produced by each of the cylinders of an automobile engine to be substantially equal. The method includes the steps of calculating the torque produced by each of the cylinders during certain respective intervals of time, thereby creating a plurality of torque values; averaging the calculated torque values; and regulating the amount of fuel injected into each of the cylinders, effective to cause each of the respective torques produced by each of the cylinders to be substantially equal to the average torque value.

Further objects, features, and advantages of the present invention will become apparent from a consideration of the following description when taken in conjunction with the accompanying drawings.

DETAILED DESCRIPTION OF THE PREFERRED EMBODIMENT OF THE INVENTION

Figure 1:
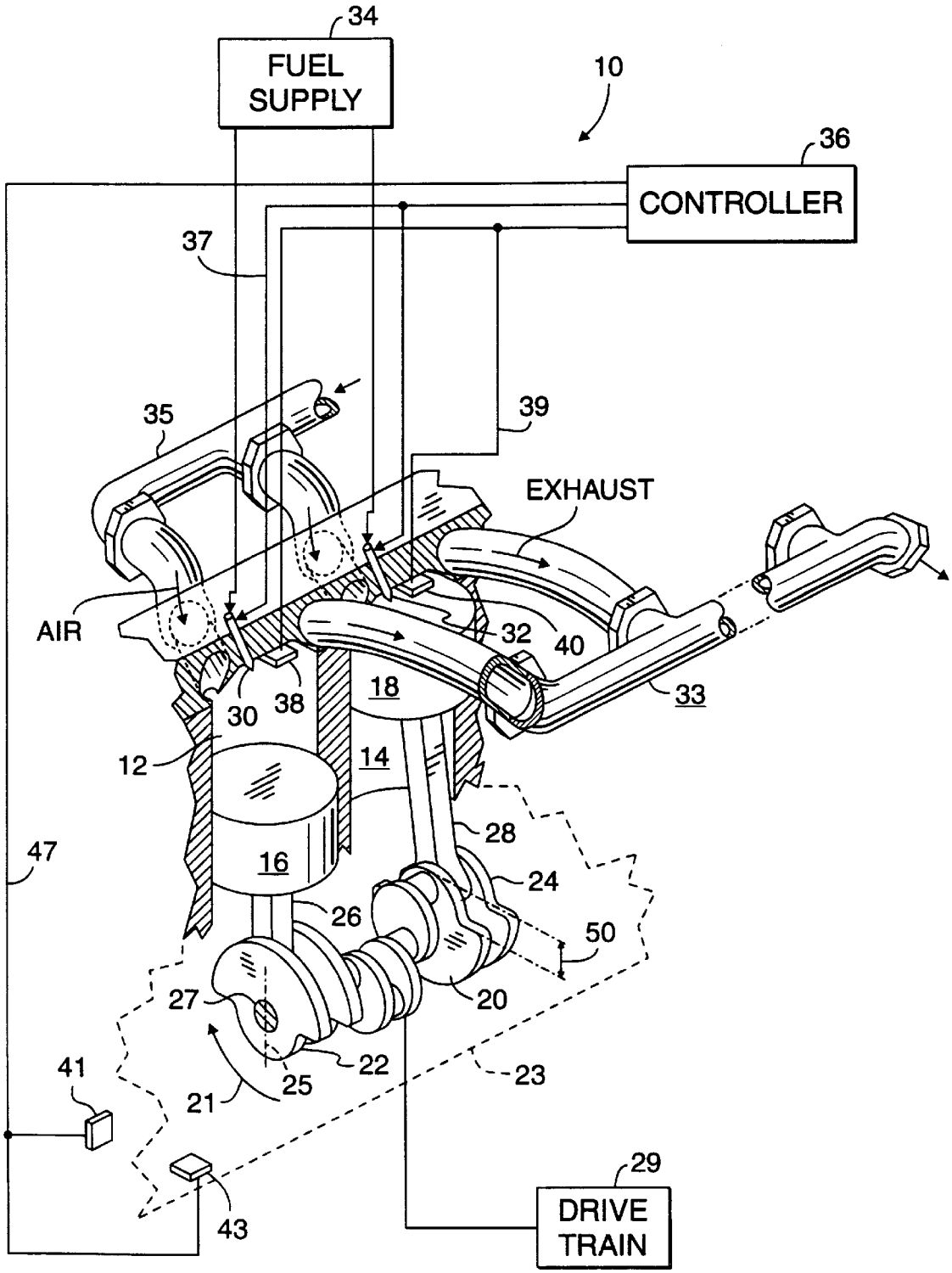
FIG. 1 is a fragmented and block diagrammatic view of an automobile combustion cylinder assembly made in accordance with the teachings of the preferred embodiment of the invention.

Referring now to FIG. 1, there is shown an automobile engine combustion cylinder assembly 10 made in accordance with the teachings of the preferred embodiment of the invention. As shown, assembly 10 includes several combustion cylinders or chambers 12, 14, each of which movably and respectively contains a unique piston 16, 18 which are respectively coupled to integrally formed projections 22, 24 of rotatable crankshaft 20 by connecting rods or "conrods" 26, 28. While two piston-containing chambers 12, 14 are shown, it should be appreciated that additional and substantially identical combustion cylinders may be included within a typical automobile engine and that the foregoing invention is equally and substantially identically applicable to these other cylinder arrangements.

As further shown in FIG. 1, each chamber 12, 14 respectively communicates with a conventional and commercially available fuel injector assembly 30, 32. Particularly, each injector 30, 32 is communicatively and selectively coupled to a source of gasoline or fuel 34 and selectively and controllably receives and injects fuel into the respective cylinders 12, 14. The injected fuel is typically mixed with a certain amount of ambient air, selectively traversing through the intake manifold 35, and this mixture is selectively combusted by use of a spark plug or other types of combustion assemblies (not shown), thereby selectively creating a certain pressure within each of the cylinders 12, 14 before being exhausted into the exhaust manifold 33.

Particularly, this selectively created combustion pressure causes the respectively contained pistons 16, 18 to cycle or move from a first extended position, in close proximity to one of the fuel injectors 30, 32, to a second crankshaft rotation position (shown in FIG. 2) in which the pistons 16, 18 respectively move away from the injectors 30, 32 and cause the respective and substantially identical conrods 26, 28 to create a torque which rotates the crankshaft 20 in the direction of arrow 21. The selectively rotating crankshaft 20, which is normally deployed within a "crank case" 23, transfers the created rotational torque or force to the automobile drive train 29, thereby allowing the automobile to be selectively moved or driven. A piston movement cycle is then completed when the pistons 16, 18 return to their respective first position. Typically, each of the cylinders 12, 14 provides one piston movement cycle within a certain designated time interval corresponding to a single engine rotation cycle or a single "firing" caused by the selective energization of each of the spark plugs contained within the automobile's spark plug assembly or by the selective increase in compression pressure, such as that occurring within a diesel engine.

As further shown in FIG. 1, assembly 10 includes a controller 36 which is operating under stored program control, which is controllably and communicatively coupled to the fuel injectors 30, 32, and which is effective to selectively control the amount of fuel injected into each of the cylinders 12 and 14. Controller 36 may comprise a conventional and commercially available microprocessor and the communication between controller 36 and the fuel injectors 30, 32 may occur by use of bus 37. Moreover, in one embodiment of this invention, controller 36 is adapted to receive signals corresponding to the instantaneous speed of the engine, such signals being available, by way of example and without limitation, by use of a conventional tachometer bus (not shown) which is typically present within the automobile engine. These received signals also enable controller 36 to determine whether the vehicle is being accelerated or whether the transmission is selectively "shifting" or providing a new gearing arrangement. Controller 36 is also coupled, by bus 47, to conventional and commercially available sensors 41, 43 which respectively measure and provide controller 36 with the pressure within crankcase 23 and the crank angle which will be described later.

Assembly 10 further includes pressure sensors 38, 40 which are respectively resident within each of the combustion cylinders 12, 14 and which each sense the pressure respectively and combustably created in each of the cylinders 12, 14 at substantially small and substantially regular intervals of time. These sensors 38, 40 create and communicate respective signals, representative of the respectively sensed pressures within the cylinders 12, 14, to the controller 36 by use of bus 39. Sensors 38, 40 may comprise conventional and commercially available piezoelectric sensors or optical sensors. Non-limiting examples of such sensors 38, 40 include the sensor commonly referred to by "model number 6125" which is produced by and is available from the Kistler Corporation and those optical sensors which are produced by and are available from Bookham Technologies, Inc.

In operation, controller 36 separately calculates the total amount of torque produced by each of the cylinders 12, 14 during each engine cycle. This is accomplished by mathematically integrating, during each engine cycle, a certain functional relationship existing between the instantaneous torque produced by each cylinder 12, 14 and certain measurable parameters or values, such as the values associated with the signals produced by each of the sensors 38, 40, 41, and 43. Particularly, in one embodiment of the invention, this functional relationship, which may be selectively and separately evaluated for each cylinder 12, 14 at an instant or interval of time, is expressed by "equation 1" below:

$$\begin{aligned}\text{Instantaneous torque} &= \hat{\tau}_i(p_{cyl}, \theta) \\ &= (p_{cyl} - p_a)\cdot A\cdot r\cdot \left(\sin\theta + \frac{r\sin\theta\cos\theta}{\sqrt{l^2 - r^2\cdot\sin^2\theta}}\right)\end{aligned} \qquad \text{(equation 1)}$$

The variables resident within equation 1 are as follows: "$P_{cyl}$" represents the value of the signals produced by one of the sensors 38, 40; "θ" represents the "crank angle" which may be defined as the angle between one of the projections 22, 24 and the substantially vertical axis 25 passing through center 27 of crankshaft 20 and which is selectively measured and transmitted by sensor 43. Of course, other angles may selectively be used.

"$P_\alpha$" represents the pressure within the crankcase which may be approximated by the ambient pressure and which is selectively measured and transmitted by sensor 41. "A" represents the cross-sectional area of each substantially identical piston 16, 18; "r" represents the crank radius shown as radius 50; and "l" represents the length of each of the substantially identical conrods 26, 28. Some of these variables may change during each instant or interval of time over which the functional relationship is being evaluated.

In the preferred embodiment of the invention, this instantaneous torque function is mathematically integrated, by controller 36, for each respective piston movement cycle of each cylinder 12, 14, as shown more clearly in Equation 2 below:

$$\tau_i = \int_0^{upperimitvalue} \hat{\tau}_i(p_{cyl}, \theta)d\theta \text{ for } i = 1, \ldots\ n \qquad \text{(equation 2)}$$

where i=a unique one of the engine's combustion cylinders and where the "upper limit value" equals 720° for a four stroke engine and 360° for a two stroke engine.

In the preferred embodiment of the invention, the foregoing total torque integral expression is separately evaluated for each cylinder 12, 14 during each engine rotation cycle in order to ensure that all of the torque produced by each of the cylinders 12, 14, in their respective piston movement cycles, is accounted for and utilized in the balancing methodology. Importantly, the foregoing methodology provides a relatively accurate and reliable measure of the total torques produced by each of the respective cylinders 12, 14 and allows for relatively accurate cylinder balancing to be selectively accomplished in a superior manner to prior balancing techniques.

In this manner and for each engine cycle, the total torque produced by each cylinder 12, 14 is separately calculated by and stored within controller 36. For each engine cycle, a mathematical average is produced. Particularly, each mathematical average is calculated by use of the total torque cylinder values occurring within a particular engine rotation cycle, according to equation 3 below:

Average of the cylinder torque values occurring within an $$\text{engine cycle} = \tau_d = \frac{1}{4}\sum \tau_i \qquad \text{(equation 3)}$$

For each engine cycle, controller 36, in the preferred embodiment of the invention, subtracts the foregoing calculated average value "$\tau_d$" from each of the previously calculated individual cylinder torque values used within the average calculation and occurring within that particular engine cycle, thereby producing or creating an imbalance value for each cylinder 12, 14.

Particularly, these imbalance values represent the amount by which each of the torques, provided by each of the respective cylinders 12, 14, in an engine cycle, respectively differ from the "average" torque value "$\tau_d$". Moreover, these imbalance values represent the amount of "correction" needed to be applied to each respective cylinder 12, 14 in order to cause each of the cylinders 12, 14 to provide substantially equal torques; each of the respective and corrected cylinder provided torques being substantially equal to this calculated average value "$\tau_d$". Alternatively, "$\tau_d$" may represent the measured torque value of one of the cylinders 12, 14, thereby obviating the need to calculate the foregoing "average value".

For each engine cycle, each of these individual imbalance values are then stored within controller 36 and separately multiplied by an adaptive correction and/or control factor which is typically a fractional value and which selectively reduces each of the respective cylinder correction values, thereby forming respective "adaptive correction and/or adaptive control" values for each of the cylinders 12, 14. These adaptive correction or control values allow the controller 36 to correct the calculated cylinder imbalances relatively slowly and in a "stepwise" manner.

This "slow or stepwise correction" is highly desirable since many of the factors, which cause cylinder imbalance, such as variations in the cylinder or fuel injectors which may be caused by a "build up" of soot, occur relatively slowly. Hence, the perceived or calculated "need" for a rather large instantaneous correction is probably due to some transient error. Rather than apply this errant and rather large correction, thereby risking inadvertently creating a relatively large and undesirable cylinder imbalance, the use of these adaptive control values allows a smaller "stepwise" correction to be made and allows the system 10 to later "recalculate" the imbalances, during other engine cycles, to determine whether the large imbalance still remains and whether additional and perhaps larger "stepwise" corrections are necessary.

In an alternate embodiment of the invention, controller 36 contains a certain limit correction value which defines the largest possible correction (e.g., the largest amount of fuel) which may be "made" within system 10 and applied to any of the cylinders 12, 14 during a single correction interval. In this embodiment, each adaptive control value is compared with this limit and the correction is made only if the limit is not exceeded. If the limit is exceeded, only the correction defined by the limit is made.

In yet another embodiment of the invention, the average value "$\tau_d$" is updated for each rotation of crankshaft 20 corresponding to and/or equaling about 180°. That is, each cylinder 12, 14 produces a total torque for each respective rotation of the crankshaft 20 equaling about 180°. Hence, as these new total torque values become available, in this embodiment, they are immediately used to update the average value "$\tau_d$" and to allow adaptive control values to be generated during each such 180° rotation of the crankshaft 20 and to thereafter be employed by system 10 in the foregoing manner.

Figure 3:
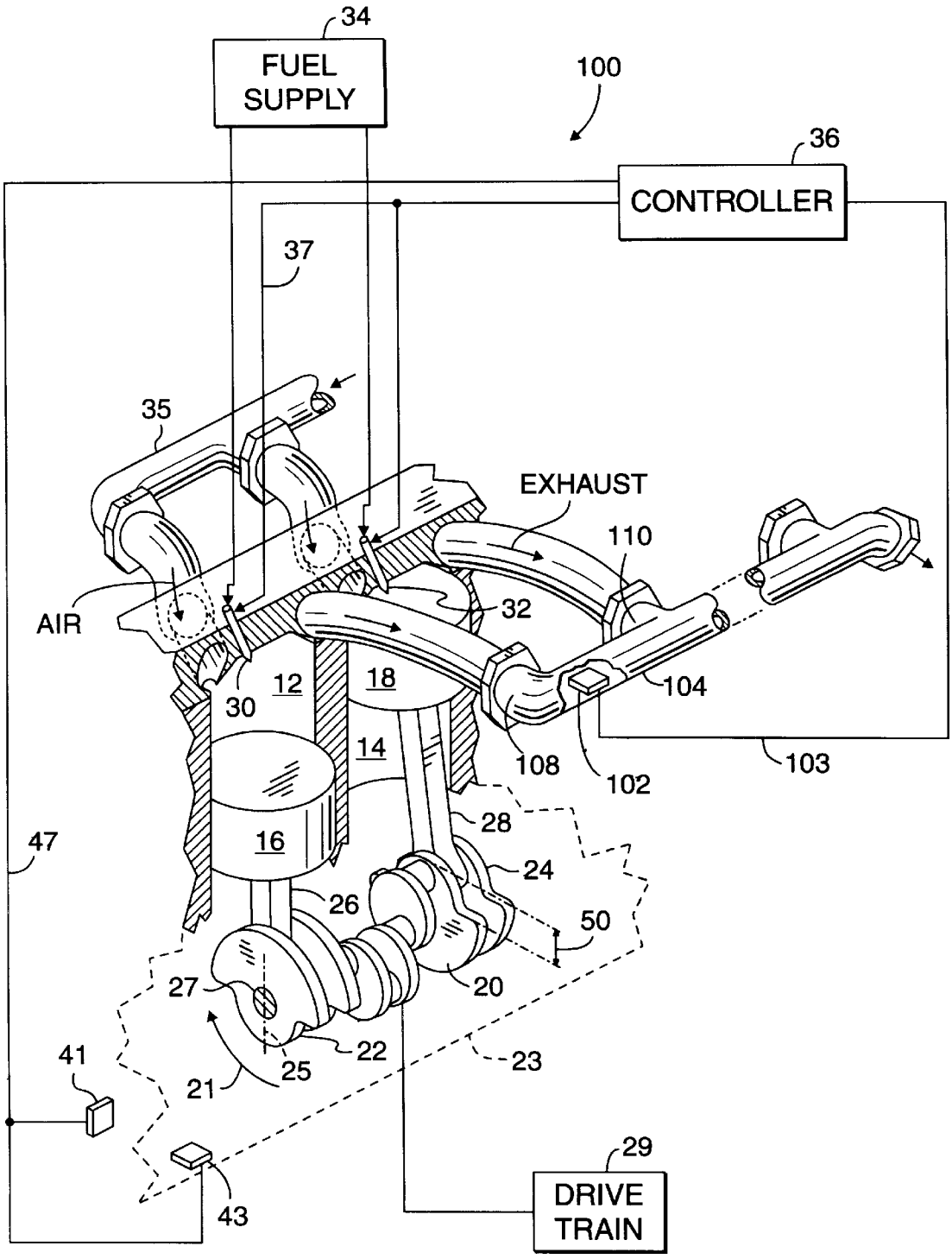
FIG. 3 is a fragmented and block diagrammatic view of an automobile combustion cylinder assembly made in accordance with the teachings of an alternate embodiment of the invention.
Figure 4:
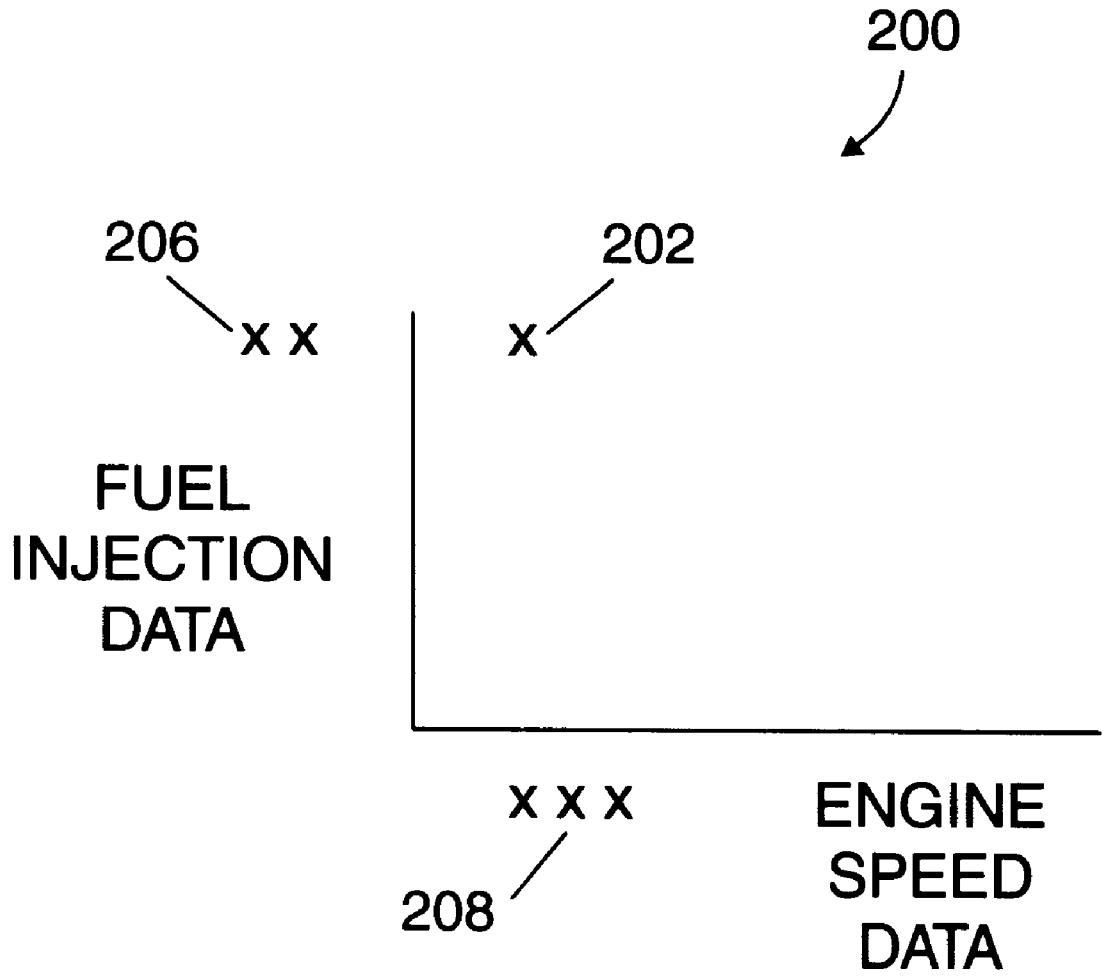
FIG. 4 is a data table utilized by each of the assemblies shown in FIGS. 1 and 2.

In the preferred embodiment of the invention, the very first adaptive control values ("the initial adaptive control valves"), each being respectively associated with a unique one of the cylinders 12, 14, are applied to the respective cylinders 12, 14 and are later stored within a separate table 200 contained within controller 36 and shown, for example and without limitation in FIG. 3. In the preferred embodiment of the invention, each cylinder 12, 14 is uniquely associated with a separate and distinct table 200 and each table 200 contains only the data which is associated with one unique cylinder 12, 14 and which is stored within controller 36.

Particularly, each table 200 initially contains a unique one of the initial adaptive correction values 202. Each value 202 is referenced within the table 200 which corresponds to the very same cylinder 12, 14 that the value 202 corresponds to. Each value 202 is referenced within the table 200 by the engine speed 208 and amount of injected fuel 206 occurring and measured when value 202 was calculated.

Each new adaptive correction value, which is calculated when the engine is at the same or substantially the same engine speed 208 and the amount of fuel being injected into the respective cylinder 12, 14 is equal or substantially equal to fuel value 206, is simply added to the previously stored correction value 202, thereby creating an updated correction value. The previous correction value 202 is replaced by this updated correction value within the table 200 and the fuel correction defined by the updated correction value is made within assembly 10. If no previous correction value 202 for a particular engine speed and fuel injection value exists within the table 200, the current adaptive correction value along with the current engine speed and the amount of fuel being injected into the corresponding cylinder 12, 14 is insertably stored within the table 202 and its specified correction is applied to the respective and corresponding cylinder 12, 14.

In the foregoing manner, controller 36 automatically contains the respective corrected fuel amount necessary to balance the cylinders 12, 14 at a particular sensed engine speed and fuel injection level. Hence, controller 36 automatically ensures that the historically required fuel corrections are made at every engine speed and fuel injection level which is referenced within each table 200, thereby automatically achieving an approximate cylinder balancing condition based upon historical data. The imbalance associated with this historically generated condition is then measured and modified in the manner described above, such modifications being placed within table 200 and forming the updated "historical data" which may be later utilized by controller 36. Each table 200 remains stored within controller 36 even after the automobile ceases to be operated or to "run". In another alternate embodiment, each updated correction value is reduced by a value equal to the arithmetic mean of all of the previous correction values in order to reduce and/or correct for non-zero biasing. In yet another alternate embodiment of the invention, balancing assembly 10 is made inoperable during vehicle accelerations or transmission gear shifting in order to reduce the probability of noise generated error.

Figure 2:
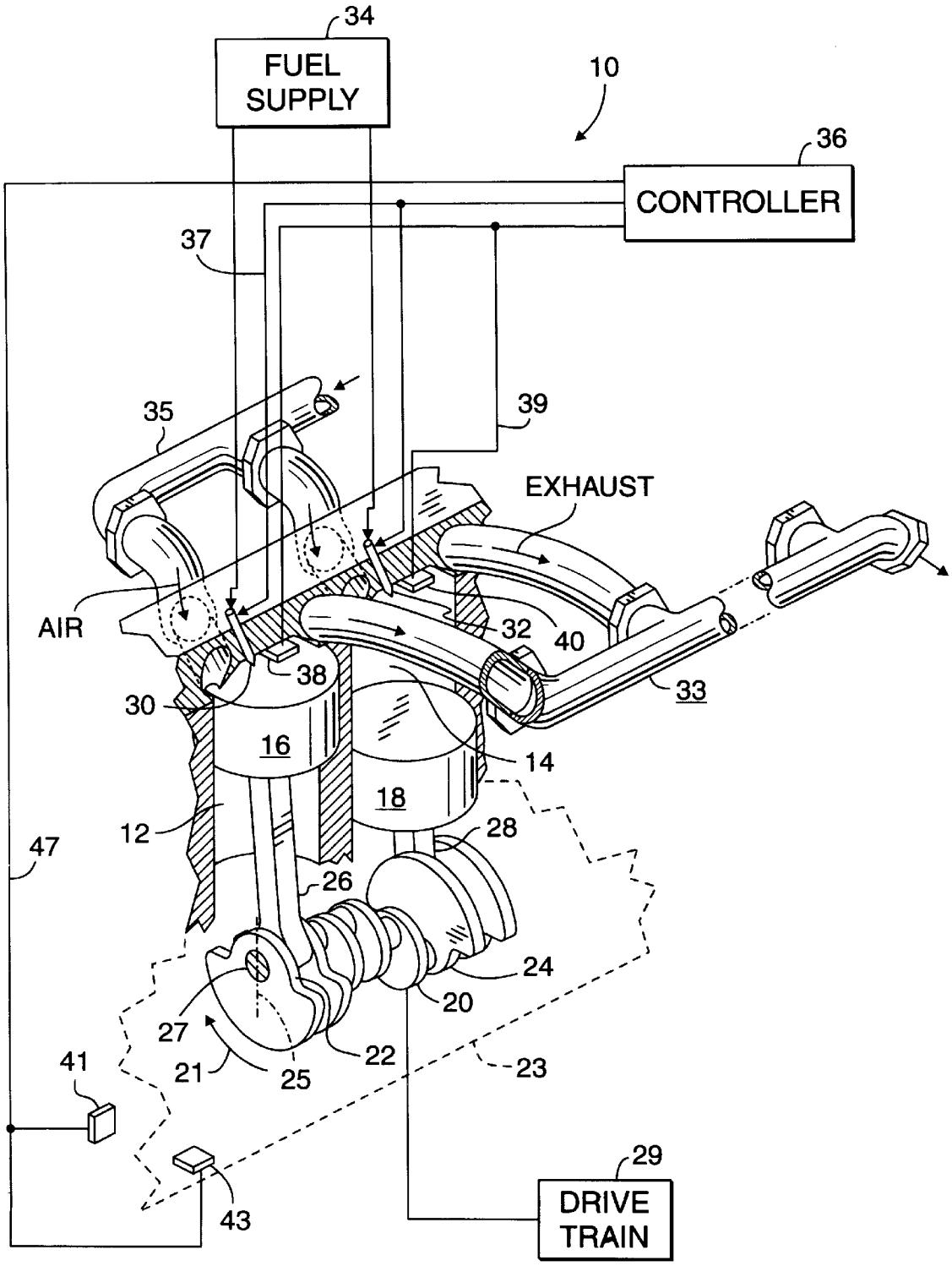
FIG. 2 is a diagram similar to FIG. 1 and illustrating the movement of the pistons.

Referring now to FIG. 2 there is shown an assembly 100 which is made in accordance with the teachings of a second embodiment of the invention and which differs from the embodiment described with respect to FIG. 1 by the use of a single sensor 102 which is selectively positioned within the exhaust manifold 104 in place of the individual cylinder sensors 38, 40.

Particularly, the combusted gas emanating from each respective cylinder 12, 14 is exhaustibly communicated to manifold 104, thereby creating a respective exhaust pressure within the manifold 104 at unique intervals of time. Each respective cylinder provided exhaust pressure is sensed or measured at relatively small intervals of time by sensor 102, which may be a commercially available piezoelectric sensor, and the measurement is included within a signal transmitted to the controller 36 along bus 103.

Applicant has discovered that there exists a direct relationship between the torque produced by a cylinder 12, 14 and the respective exhaust pressures created within the exhaust manifold 104 by that cylinders 12, 14. The second embodiment utilizes this relationship to selectively measure the various cylinder-produced torques and to selectively provide cylinder balance.

Particularly, in this second embodiment of the invention, controller 36 separately calculates or measures, for each exhaust manifold 104, the total exhaust pressure produced by each of the cylinders 12, 14 communicating with each respective manifold 104, according to the following equation 4.

$$\overline{p}_i = \int_{\phi_1}^{\phi 2} p_x(\theta) d\theta; \qquad \text{(equation 4)}$$

$i = 1$ total number of cylinders for each respective exhaust manifold

Where the variables are as follows: "$P_x$" is the manifold pressure; "i" denotes a cylinder; "θ" is the "crankangle" and where "$\phi_1$" and "$\phi_2$" are respective offset angles.

Particularly, in this non-limiting single manifold example, each of the cylinders 12, 14 has a respective manifold exhaust pressure which is evaluated for every portion of the engine rotation cycle for which they respectively produce or exhausts gas into the manifold 104 (e.g., the first cylinder exhausts gas between the angles of "$\phi_1$" and "$\phi_2$" It of the crankshaft). These angles ("$\phi_1$", "$\phi_2$") therefore become the integral limits used by controller 36 in evaluating the integral equation 4 and they equal different angular values depending upon the identity of the cylinder 12, 14 whose exhaust pressure is being evaluated and/or measured (e.g., they respectively equal the lowest and highest "crankangle" associated with the production of exhaust gases by that cylinder). In the preferred embodiment of the invention, each angle "$\phi_1$" and "$\phi_2$" is respectively increased by a certain offset angle in order to account for the transport delay associated with the communication of the cylinder produced exhaust gasses into the manifold 104.

Each of these individual exhaust pressure values is then multiplied with a first correction factor which accounts for bias associated with the placement of the sensor 102 within the manifold 104, thereby creating respective first imbalance values for each cylinder 12, 14. That is, the closer that the sensor 102 is placed within the exhaust manifold 104 to a particular and respective cylinder 12, 14 exhaust output, the greater will be its "reading" or "measurement" of the exhaust pressure of that cylinder 12, 14. Moreover, the "measurement" of the respective exhaust pressures from the remaining cylinders 12, 14 will concomitantly be unduly minimized or restricted since the pressures from these other cylinders 12, 14 will have been reduced within the manifold 104 before "reaching" or being sensed by pressure sensor 102.

Accordingly, in one embodiment of the invention, the distance from the exhaust manifold contained sensor 102 to the center of each of the respective interface ports 108, 110 is measured and averaged (e.g., interface port 108 is associated with and/or used by cylinder 12 to exhaust combusted products while port 110 is similarly used by cylinder 14). A correction factor, for each cylinder 12, 14, is created and, in one non-limiting embodiment, is respectively defined by a numerator equaling the distance between the center of the respectively associated interface port 108, 110 and the sensor 102 and a denominator equally the average distance between the sensor 102 and the center of each respective port 108, 110. The respective first cylinder imbalance values "$\gamma_i$" are then averaged according to equation 5 below:

$$\gamma_d = \sum \gamma_i \cdot \frac{1}{4} \qquad \text{(equation 5)}$$

These values are subtracted from each of the measured pressures to obtain a respective initial correction value which is then multiplied by an adaptive correction factor resulting in the creation of separate adaptive correction and control values, for each cylinder, which allow controller 36 to correct for calculated cylinder imbalances relatively slowly and in a "stepwise" manner. The correction factor may be substantially similar to the correction factor used within the first embodiment of the invention. The resulting adaptive correction factors may thereafter be used in a substantially similar manner to those factors which have been previously described with respect to the first embodiment of the invention. In yet another embodiment of the invention, a separate sensor 102 is employed in each exhaust manifold of a multi-exhaust manifold engine, thereby allowing each of the cylinders 12, 14 to be selectively balanced in a desired manner.

It should be understood that this invention is not to be limited to the exact construction or embodiment described above but that various changes may be made without departing from the spirit or the scope of the invention.

What is claimed is:

1. A cylinder balancing assembly for use in combination with an automobile engine having a plurality of cylinders which each contain a movable piston, said engine further including a selectively rotatable crankshaft, a plurality of conrods which each connect a unique one of said pistons to said crankshaft, and a plurality of fuel injectors which are each adapted to receive a quantity of fuel and to selectively inject said fuel into a unique one of said cylinders, said injected fuel being selectively combined with air and combusted within each of said cylinders effective to create a certain and respective pressure which selectively cycles the received and respective pistons between a first extended position and a second crankshaft rotation position, thereby causing each cylinder to produce a torque when the respectively contained piston rotates said crankshaft and then completes a movement cycle by returning to the respective first position, said cylinder balancing assembly comprising:

a plurality of sensors which are each positioned within a unique one of said cylinders, which each sense said pressure of a unique one of said cylinders and which each provide an output signal representing said respectively sensed pressure; and a controller, coupled to said plurality of sensors and to said plurality of fuel injectors, said controller receiving said output signals from each of said plurality of sensors and using said output signals to calculate the total amount of torque produced by each of said cylinders and based upon said calculation, regulating said amount of fuel entering each of fuel injectors effective to cause each of the produced torques to be substantially equal, thereby balancing the cylinders;

wherein said controller averages said total amount of said torques produced by each of said cylinders and creates an average torque value, said controller further using said average torque value to create an imbalance value for each of said cylinders, said controller further multiplying each of said cylinder imbalance values by an adaptive control factor effective to separately create an adaptive correction value for each of said cylinders, and said controller further regulating said amount of fuel being injected into each of said cylinders in accordance with said created adaptive correction values.

2. The cylinder balancing assembly of claim 1 wherein said correction factor is a fractional value.

3. The cylinder balancing assembly of claim 1 wherein said engine is operating at a certain speed and each of said cylinders respectively receives a certain amount of fuel before said adaptive correction values are calculated, said controller further storing each of said adaptive correction values, uniquely associating each of said adaptive correction values with a first value substantially equal to said engine speed and with a second value substantially equal to a unique one of said injected fuel amounts, and further storing each of said first and second values.

4. The controller of claim 3 being further adapted to automatically regulate the amount of fuel received by said fuel injectors according to said stored correction values.

5. A cylinder balancing assembly for use in combination with an automobile engine having a plurality of cylinders which each contain a movable piston, said engine further including a rotatable crankshaft, a plurality of conrods which each connect a unique one of said pistons to said crankshaft, and a plurality of fuel injectors which are each adapted to receive a quantity of fuel and to selectively inject said fuel into a unique one of said cylinders, said injected fuel being selectively mixed and combined with air and combusted within each of said cylinders effective to create a certain and respective pressure which selectively cycles the received and respective pistons between a first extended position and a second crankshaft rotation position, thereby causing each cylinder to produce a torque when the respectively contained piston rotates said crankshaft and then completes a movement cycle by returning to the respective first position, each of said cylinders communicatively coupled to an exhaust manifold and selectively exhausting said combusted mixture into said manifold at a certain and respective exhaust pressure, said cylinder balancing assembly comprising:

at least one sensor resident within said exhaust manifold which separately senses said exhaust pressure of each of said cylinders and which provides at least one output signal representative of each of these separately sensed exhaust pressures; and a controller, coupled to said at least one sensor and to said plurality of fuel injectors, said controller receiving said at least one output signal and using said received signal to be calculate the total amount of torque produced by each of said cylinders and, based upon said calculation, regulating said amount of fuel entering each of said fuel injectors effective to cause the produced torques to be substantially equal, thereby balancing the cylinders.

6. The cylinder balancing assembly of claim 5 wherein said controller averages said total amount of said torques produced by each of said cylinder and creates an average torque value, said controller further regulating said amount of fuel effective to cause each of said produced torques to be substantially equal to said average torque value.

7. The cylinder balancing assembly of claim 5 wherein said controller averages said total amount of said torques produced by each of said cylinders and creates an average torque value, said controller further using said average torque value to create an imbalance value for each of said cylinders, said controller further multiplying each of said cylinder imbalance values by an adaptive control factor effective to separately create an adaptive correction value for each of said cylinders, said controller further regulating said amount of fuel being injected into each of said cylinders in accordance with said created adaptive correction values.

8. The cylinder balancing assembly of claim 7 wherein said correction factor is a fractional value.

9. The cylinder balancing assembly of claim 8 wherein said engine is operating at a certain speed and each of said cylinders respectively receive a certain amount of fuel before said adaptive correction values are calculated, said controller further storing each of said adaptive correction values, uniquely associating each of said adaptive correction values with a first value substantially equal to said engine speed and with a second value substantially equal to a unique one of said injected fuel amounts, and further storing each of said first and second values.

10. The controller of claim 7 being further adapted to automatically regulate the amount of fuel received by said fuel injectors according to said stored correction values.

11. A method to cause the torque produced by each of the combustion cylinders of an automobile engine to be substantially equal, each of said combustion cylinders having a piston with a certain and respective cross-sectional area, said engine further including a movable crankshaft having a plurality of extended portions each having a certain and respective length and which are each connected to a unique one of said movable pistons, said engine further including a plurality of fuel injectors which are each adapted to selectively receive and inject an amount of fuel into a unique one of said cylinders, said selectively injected fuel being combusted within said cylinders effective to create a certain and respective pressure in each of said cylinders which moves each of said respectively received pistons from a first extended position to a second position in which each of said respectively contained pistons creates a torque which rotates said crankshaft before returning to their respective first position in order to respectively complete a single cycle of piston movement, said method comprising the steps of:

calculating said total amount of torque produced by each of said cylinders during each respective cycle of piston movement, thereby creating a plurality of torque values;

averaging said plurality of calculated torque values, thereby creating an average torque value;

regulating said amount of fuel injected into each of said cylinders, effective to cause each of the respective torques, produced by each of the cylinders, to be substantially equal to the calculated average torque value, thereby balancing said cylinders; and wherein said step of calculating said total torque produced by each of said cylinders during each piston movement cycle includes the steps of:

measuring each of said respective pressures;

subtracting the value of the ambient atmospheric pressure from each of said measured and respective pressures, thereby creating a plurality of first values which are each uniquely associated with one of said cylinders;

multiplying the length of each of said extended portions of said crankshaft with a value substantially equal to the cross-sectional area of one of said pistons, thereby creating a plurality of second values which are each uniquely associated with one of said cylinders;

multiplying said first and said second values of each of said cylinders, thereby creating a plurality of third values which are each uniquely associated with one of said cylinder;

creating a fourth value for each respective cylinder, said fourth value being dependent upon a certain position of said crankshaft;

multiplying said third and fourth values of each of said cylinders, thereby creating a plurality of torque values which are each associated with a unique one of said cylinders;

averaging said plurality of torque values, thereby crating a fifth value; and regulating said amount of fuel which is injected into each of said cylinders, thereby causing the torque produced by each of said cylinders to be substantially equal to said fifth value.

12. The method of claim 11 wherein said steps of measuring each of said respective pressures comprises the steps of:

providing a plurality of pressure sensors; and placing each of said pressure sensors into a unique one of said plurality of cylinders.

13. The method of claim 11 wherein said engine further includes an exhaust manifold which communicates with each of said cylinders, said steps of measuring each of said respective pressures comprises the steps of:

providing a pressure sensor; and placing said pressure sensor within said exhaust manifold.

14. A method of adaptively balancing each of the fuel receiving and torque producing cylinders of an automobile engine, said method comprising the steps of:

determining a first amount of imbalance of each of the cylinders;

creating a first fuel correction value for each cylinder;

storing each of said first fuel correction values;

modifying said fuel received by each of said cylinders in accordance with said first correction values;

determining an amount of imbalance of each of said cylinders;

creating an adaptive correction factor for each of said cylinders by multiplying each of said amount of respective imbalances by a certain correction factor;

adding each of said adaptive correction factors to a unique one of said stored first correction values, thereby creating a plurality of second correction values;

storing each of said second correction values; and modifying said fuel received by each of said cylinders in accordance with said stored second correction values, thereby adaptively balancing said cylinders.

15. The method of claim 14 wherein said automobile engine operates at a certain speed, said method further comprising the steps of:

determining a first speed of said engine when said first correction values are created;

determining a second speed of said engine when said amount of imbalance is determined; and adding each of said adaptive correction factors to said first correction values only if said first and said second speeds are substantially similar.

16. The method of claim 15 further comprising the steps of:

determining a first amount of fuel received into at least one of said cylinders when said first correction values are created;

determining a second amount of fuel received into said at least one of said cylinders when said amount of imbalance is determined; and adding each of said adaptive correction values only if said first and said second amounts of fuel are equal.

* * * * *